United States Patent [19]

Marz

[11] 4,420,440

[45] Dec. 13, 1983

[54] FILM CARTRIDGE MANUFACTURE AND FILLING METHOD AND APPARATUS

[75] Inventor: Horst F. Marz, Otterburn Park, Canada

[73] Assignee: C-I-L Inc., North York, Canada

[21] Appl. No.: 450,144

[22] Filed: Dec. 15, 1982

[30] Foreign Application Priority Data

Feb. 2, 1982 [CA] Canada ..... 395363

[51] Int. Cl.[3] ..... C06B 21/00

[52] U.S. Cl. ..... 264/3 B; 264/3 R; 86/1 R; 86/20 R; 149/109.6

[58] Field of Search ..... 264/3 B, 3 R; 86/20 R, 86/1 R; 149/109.6

[56] References Cited

U.S. PATENT DOCUMENTS 3,265,778 8/1966 Griffith ..... 264/3 B 3,608,421 9/1971 Gibbon et al. ..... 264/3 B

*Primary Examiner*—Stephen J. Lechert, Jr.
*Assistant Examiner*—Joel P. Okamoto
*Attorney, Agent, or Firm*—Donald G. Ballantyne

[57] ABSTRACT

A method and apparatus is provided for cartridging viscous explosives mixtures, such as emulsion explosives, in convolutely wound paper tubes. The method comprises winding a section of paper film on a rotating hollow mandrel, closing one end of the wound paper tube, injecting the explosives mixture through the hollow mandrel into the paper tube upon the mandrel, removing the filled tube from the mandrel and closing the tube open end. The method replaces higher cost plastic chub packages with low cost paper and allows the efficient and economic production of sensitive small-diameter cartridges wherein the occluded air or gas is not dissipated during cartridging.

9 Claims, 4 Drawing Figures

FILM CARTRIDGE MANUFACTURE AND FILLING METHOD AND APPARATUS

This invention relates to an apparatus and method for filling convolute film packages with viscous, plastic, gelatinous or emulsified products. The invention has particular application to the packaging of water-in-oil or oil-in-water emulsion explosive compositions in convolute paper packages.

Emulsion blasting agents, such as those disclosed by Harold F. Bluhm in U.S. Pat. No. 3,447,978 granted June 3, 1969, are finding increasing commercial usage because of their inherent safety in manufacture and use and their high brisance. Generally, these blasting agents basically comprise a liquid aqueous phase containing one or more dissolved oxygen-supplying salts, a liquid carbonaceous fuel phase, an occluded gas or gas-containing material such as resin or glass microspheres and an emulsifier. Preferably the aqueous phase is the discontinuous phase. Additional materials may be incorporated in the basic composition such as emulsifying agents, sensitizers, for example, particulate organic explosives, fuels, for example, sulphur and aluminium, thickeners, for example quar gum, and cross-linkers, ph-controllers, crystal habit modifiers, liquid extenders, bulking agents and other additives of common use in the explosive art. Depending on their composition, these emulsion explosives may be relatively insensitive and capable of initiation only in relatively large diameters using a booster charge. Alternatively, emulsion explosives may be formulated to be sensitive to blasting cap initiation in small diameter charges of say, 3.5 cm diameter or less. These cap-sensitive, small diameter charges are rendered sensitive by the inclusion therein of a proportion of a particulate self-explosive or substantial amounts of air by the means of resin or glass microspheres or both. The use of microspheres as a sensitizing agent is the material of choice.

Heretofore, emulsion explosive compositions, like aqueous slurry explosives, have been packaged in plastic film, tubular, chub packages. Such packaging means have been considered essential because of the rheology of the compositions and their high liquids content. Chub packages are both practical and economic, particularly where the package sizes and unit volumes are large. The use of chub packaging for small diameter cartridges, especially for air-sensitized emulsion explosives, is, however, not without disadvantages. These disadvantages are particularly evident when small diameter chub packaging efficiencies and costs are compared with those of conventional convolute paper, dynamite type packaging. Additionally, small diameter chub packages, because of their rounded, sausage-shaped ends, have a tendency to override each other in the borehole, causing jamming. Also, paper cartridges are more easily tamped in the borehole. Advantages also lie with dynamite type packaging in matters of material cost, unit volume of output and better borehole loading. However, the physical nature and rheology of emulsion explosives prevent the direct adaptation of dynamite or gelatin cartridging apparatus.

Conventional filler apparatus operating at high production rates requires the use of extrusion pressures which rupture substantial numbers of the microsphere ingredient thus increasing the density of the emulsion explosive and reducing its sensitivity. Additionally, the means employed to cut off flow of product in conventionally operated cartridging apparatus, namely, a mechanical valve mounted within the extrusion or filling nozzle, also acts to crush the microspheres resulting in insensitive packaged products.

It has now been found that emulsion explosive compositions and other slurry-like explosive compositions containing resin or glass microspheres or similar void-containing material as a sensitizing agent may be cartridged in convolute paper tubes at high rates of productivity without loss of explosive sensitivity due to crushing of the microspheres or the like.

According to the present invention, a method for packing viscous, gel-like explosives into convolute paper tubes is provided which comprises the steps of (a) feeding a pre-cut length of paper film to a continuously rotating, hollow winding/extrusion mandrel to form a cylindrical convolutely-wound paper shell thereon, (b) closing one end of the said paper shell upon the said mandrel by means of an inwardly folded crimp, (c) extruding a cylindrical column of viscous, gel-like explosives through a tubular element within the said hollow mandrel and into and against the crimp-closed end of said paper shell, the said shell being simultaneously slid along the said mandrel by the force of the explosive extrudate, (d) cutting and separating the said cylindrical explosive column at a point adjacent the leading open end of the said mandrel and indented within the said paper shell to provide an unfilled paper shell end portion, (e) displacing the said filled paper shell from the said mandrel, (f) restraining the said displaced, filled shell in a holding means, and (g) closing the said open end of said restrained, filled paper shell by means of an inwardly folded crimp.

In order to illustrate the invention, an apparatus for the forming of convolute paper shells and the placing therein of a viscous, gelatinous product will be described with reference to the accompanying drawings wherein FIG. 1 is a diagrammatic representation of the apparatus employed in the method of the invention;

Figure 1:
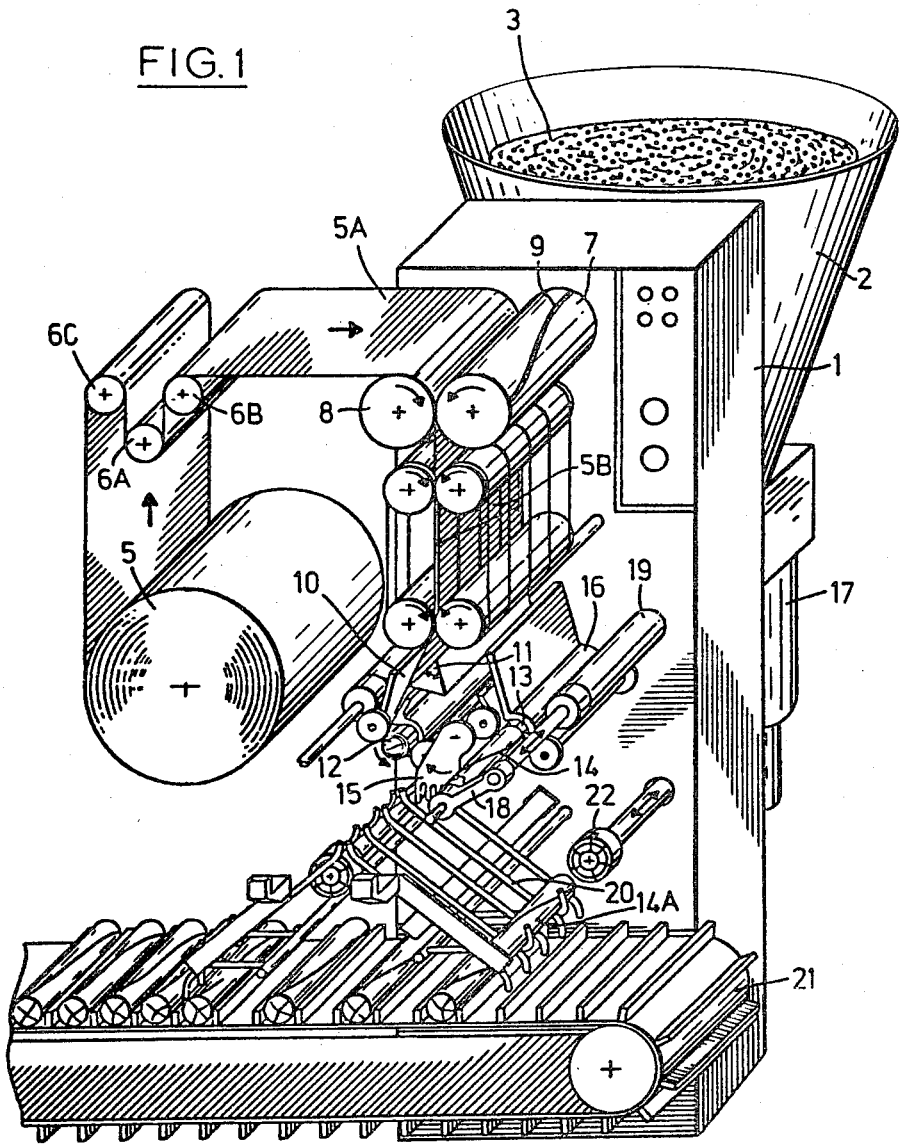
Figure 2:
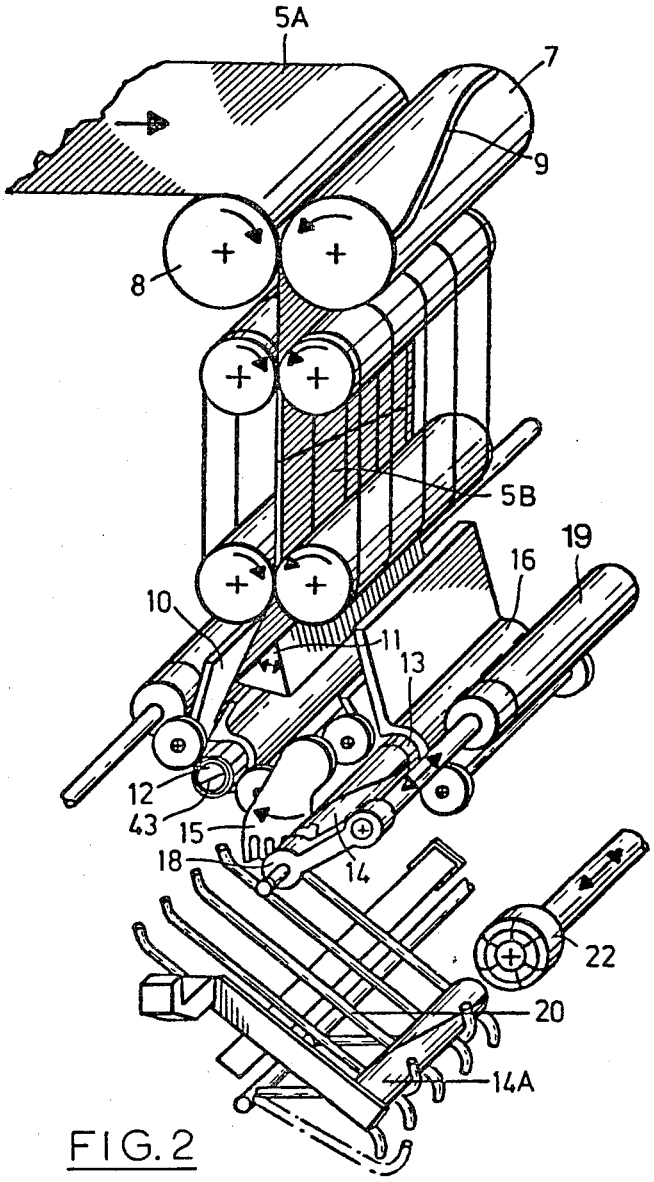
FIG. 2 is an enlargement of the central tube winding and filling components of the apparatus of FIG. 1.
Figure 4:
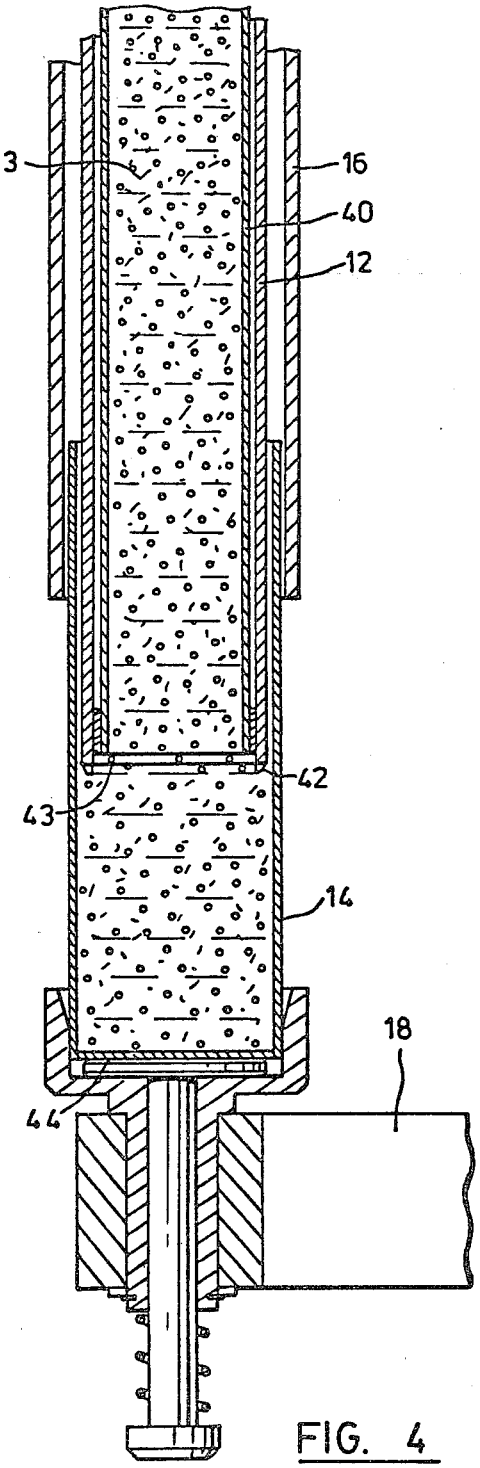

Referring to FIGS. 1 and 2, there is shown a floor-mounted pedestal 1 containing (not shown) the drive mechanism for the moveable elements of the apparatus. Mounted upon pedestal 1 is a receiving hopper 2 charged with bulk, viscous material 3 for packaging. Paper film roll 5 provides a source of film packaging materials 5A which is drawn through tensioning rolls 6A, 6B and 6C and thence between driven cutter roll 7 and backing roll 8. Rolls 7 and 8 are connected to a rotating drive mechanism within pedestal 1. A special knife edge 9 is shown on the surface of roll 7. As film material 5A is drawn from source 5, it is cut into parallelogram-shaped sheets 5B by knife edge 9 on roll 7. The cut sheets 5B are delivered into pocket guide 10. Deflector bar 11 is mounted for reciprocal movement in order to direct cut sheets 5B from material 5A successively towards winding mandrels 12 and 13. Mandrels 12 and 13 are connected to a rotating drive mechanism within pedestal 1. Cut film sheets 5B are formed into convolute paper tubes, shown, for example, at 14 by means of winding mandrels 12 and 13. The projecting open film tube end of tube 14 is folded closed by means of a rotating crimper finger mechanism 15. Winding mandrels 12 and 13 comprise a fixed mandrel housing 16, surrounding a winding mandrel (not shown) and a fixed internal hollow pipe (not shown) which construction is shown in FIG. 4. This internal hollow pipe functions as an extrusion nozzle for the bulk material 3 within hopper 2. Mechanisms are provided (not shown) within piston dispenser assembly 17 whereby measured volumes of bulk material 3 from hopper 2 is injected through the extrusion nozzle into the crimped film tube supported on the winding mandrel 13. As the tube 14 is filled with bulk explosive material, it is pushed from winding mandrel 13 against the resistance of a reciprocating retaining arm 18 and associated pneumatic piston 19. The resistance of retaining arm 18 against the end of tube 14 causes the bulk explosive to take up the full volume within tube 14. After filling, tube or cartridge 14 is ejected and falls by gravity to sloping receiving guide rails or rack 20 where it is held in position for the closing of its open end by means of, for example, a cam or pneumatically operated crimper 22. Thereafter, the complete, filled cartridge, designated 14A, falls or is directed to a conveyor mechanism 21 which carries it away to a casing unit, not shown. The apparatus is arranged so that bulk material is sequentially injected into end-crimped film tubes on each of the winding mandrels 12 and 13, the extrusion cycles being governed by, for example, a mechanised interlock (not shown) within pedestal 1 associated with a piston assembly and drive as shown at 17.

Figure 3:
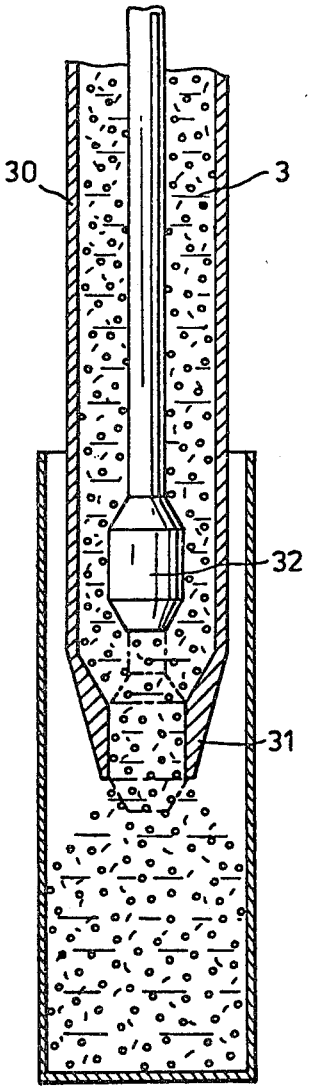
FIG. 3 PRIOR ART
FIG. 3 is a view partly in cross-section of a prior art extrusion nozzle and FIG. 4 is the extrusion/winding nozzle combination used in the apparatus of FIG. 1.

With reference to FIG. 3, which shows a cross-sectional view of a conventional or prior art extrusion nozzle, there is shown a hollow extrusion pipe 30 having a reduced diameter outlet end 31. Spool valve 32 adapted for reciprocal movement is shown mounted within pipe 30. The cylindrical wall of spool valve 32 contacts the inner wall surface of outlet 31, in order to cut off the flow of viscous material 3 being extruded through pipe 30. This depicted mechanism tends to suffer from the disadvantage that the cut-off of the flow of viscous material 3 through the extrusion pipe 30 is not always clean, resulting in residual portion of extrudate at the tip of spool valve 32. This extrudate can produce a contaminated package. In addition, where the viscous material being extruded is of the type which contains essential, gas-filled microspheres or particulate porous particles, the pressure required at high extrusion rate of the viscous material around spool piece 32 and through a reduced diameter cross-section within pipe 30 causes substantial breakage of the microspheres during extrusion. This condition is aggravated as the diameter of pipe 30 is reduced.

FIG. 4 shows in cross-section an extrusion nozzle used in the apparatus of FIG. 1 in combination with a convolute film winding mandrel. There is shown an untapered, hollow extrusion pipe 40 which is surrounded by a rotatable winding mandrel 12 driven from a source (not shown). Mandrel 12 at its leading end 42 projects slightly beyond the end of pipe 40. Stretched and secured across the diameter of rotating mandrel end 42 is cutting wire 43. Around rotating mandrel 12 is a non-rotating or fixed mandrel housing 16. Housing 16 contains a longitudinal slot (not shown) along its full length, through which slots of film (not shown) are passed to be convolutely wound by and against rotating winding mandrel 12. A convolutely wound cylindrical film package having a closed end 44 is shown at 14. As extrudate viscous material 3 is forced through extrusion pipe 40 in the direction of the arrow, the formed package 14 is caused to be pushed from the rotating mandrel 12 in the arrow direction. When a predetermined volume of extrudate has been injected into package 14, forward motion of the extrudate in pipe 40 is halted and rotating wire 43 mounted in pipe end 42, cleanly severs the column of extrudate and filled film package 14 is drawn away from mandrel 12.

In operation, and with reference to the figures of the drawing, convolutely wound film packages such as shown at 14 in FIGS. 1, 2 and 4, are formed alternatively on rotating winding mandrels 12 and 13 (FIG. 1) from film sections cut between rolls 8 and 9 from film source 5. The ends of the film packages are crimped closed as shown at 44 (FIG. 4) by means of rotating finger crimper 15 or a star crimper (not shown). After being crimped closed, the film packages retained on and surrounding mandrels 12 and 13 are filled with extrudate drawn from a bulk material supply 3 within hopper 2. The extrudate is injected alternatively through each central extrusion pipe 40 within hollow mandrels 12 and 13 into film packages 14 in predetermined or selected volumes depending on the volume of package 14. Extrudate volumes are preselected or set by regulating the stroke of, for example, a piston dispenser extrusion mechanism as shown at 17. After charging with a chosen volume of extrudate, the column of extrudate within and near the open end of package 14 is severed by means of rotating wire 43 mounted at the end of winding mandrels 12 and 13. Charged package 14 is withdrawn from winding mandrel 12 or 13 aided by reciprocating retaining arm 18 and is guided into receiving rack 20 where it is held until its open end is crimped closed by means of crimper 22. If required, provision can be made for the application of an adhesive or other sealing material at the time the crimp or closure is made to the end of cartridge 13. The fully closed package, designated 14A, is passed from rack 20 into, for example, a conveyor 21 for delivery to a gathering station or casing unit. Thus a totally integrated cylindrical film cartridge manufacture and filling operation is provided which is adaptable to the production of a range of cartridge diameters and volumes.

The mechanisms employed for the cutting of film sections 5B from packaging material 5A the winding of the film sections 5B into film tubes 14 by means of winding mandrels 12 and 13 and the end crimping of the wound film tubes by means of finger crimper element 15 is described in U.S. Pat. No. 1,575,894 granted to William T. Ayer. Any common mechanical drive apparatus may be employed to power the aforementioned tube winding and crimping mechanism, which drive apparatus is conveniently housed within pedestal unit 1. The mechanism employed for the proportioned injection or extrusion of bulk material 3 into formed cartridges 14 preferably comprises a piston dispenser apparatus. The crimper means 22 employed to close the end of the filled cartridge held in rack 20 is preferably operated by a mechanical cam arrangement within pedestal 1 but may also be operated pneumatically.

The film material used to make the convolute wound cartridge 14 or 14A is preferably a kraft paper which has been treated for oil resistance by, for example, coating one surface with an oil-insoluble resin such as polytetrafluoroethylene or the like.

I claim:

1. A method for packing viscous, gel-like explosives into convolute paper tubes which comprises the steps of (a) feeding a pre-cut section of paper film to a continuously rotating, hollow winding/extrusion mandrel to form a cylindrical convolutely wound paper shell thereon, (b) closing one end of the said paper shell upon the said mandrel by means of an inwardly folded crimp, (c) extruding a cylindrical column of viscous, gel-like explosives through a tubular element within the said hollow mandrel and into and against the crimp-closed end of said paper shell, the said shell being simultaneously slid along the said mandrel by the force of the explosive extrudate, (d) cutting and separating the said cylindrical explosive column at a point adjacent the leading open end of the said mandrel and indented within the said paper shell to provide an unfilled paper shell end portion, (e) displacing the said filled paper shell from the said mandrel, (f) restraining the said displaced, filled shell in a holding means, and (g) closing the said open end of said restrained filled shell by means of an inwardly folded crimp.

2. A method as claimed in claim 1 comprising the additional step of providing a resistant force against the exterior of the crimp-closed end of the said paper shell during explosive extrusion.

3. A method as claimed in claim 1 wherein the said pre-cut sections of paper film are fed alternatively to more than one winding/extrusion mandrel.

4. A method as claimed in claim 1 wherein the said paper film comprises a kraft paper having a least one resin-coated surface.

5. A method as claimed in claim 1 wherein the said explosive is extruded in measured volumes by means of a piston dispenser.

6. A method as claimed in claim 1 wherein the said explosive column is cut and separated within the said filled shell by means of a taut wire supported at the leading end of the said rotating mandrel.

7. An apparatus for the packing of viscous gel-like explosive into convolute paper tubes comprising in combination:

(a) a rotating cutter whereby selected sections of paper film are cut from a paper source, (b) a feeder whereby said pre-cut paper sections are fed to a rotating, paper-winding mandrel, (c) a hollow, rotating, paper-winding mandrel whereon a pre-cut paper section is formed into a convolutely wound paper tube, the said hollow mandrel having an internal hollow extrusion tube through which viscous explosives may be passed and said hollow mandrel also having a taut wire cutting means affixed to its leading end, (d) a crimping means whereby the open leading end of the said convolutely wound paper tube may be folded closed upon said winding mandrel, (e) dispensing extrusion means whereby a measured volume of explosive is charged into the said wound and crimped paper tube upon the said mandrel, the charge tube being displaced from the said mandrel, (f) holding means whereby the said displaced, explosive-charged paper tube is restrained for end closure, and (g) crimping means whereby the open end of the said explosive-charged paper tube is folded closed.

8. An apparatus as claimed in claim 7 also comprising means whereby the said pre-cut paper sections are fed alternatively to more than one paper-winding mandrel.

9. An apparatus as claimed in claim 7 also comprising a restraining means adapted to apply a resistance force against the crimp-closed end of the said paper tube during the charging of the said tube with explosives.

* * * * *